US005655510A

United States Patent [19]

Kunimoto

[11] Patent Number: 5,655,510

[45] Date of Patent: Aug. 12, 1997

[54] MODEL GUN WITH TRAJECTORY CONTROL FUNCTION

[75] Inventor: Keiichi Kunimoto, Tokyo, Japan

[73] Assignee: Western Arms, Tokyo, Japan

[21] Appl. No.: 680,950

[22] Filed: Jul. 16, 1996

[30] Foreign Application Priority Data

Aug. 3, 1995 [JP] Japan ..... 7-198257

[51] Int. Cl.[6] ..... F41B 11/00

[52] U.S. Cl. ..... 124/81; 124/73

[58] Field of Search ..... 124/56, 66, 67, 124/73, 74, 81

[56] References Cited

U.S. PATENT DOCUMENTS

| | | | |
|---|---|---|---|
| 2,182,369 | 12/1939 | Barron | 124/81 |
| 3,838,676 | 10/1974 | Kahelin | 124/81 X |
| 5,265,583 | 11/1993 | Otto | 124/81 |
| 5,413,085 | 5/1995 | Kraeft | 124/81 |
| 5,450,838 | 9/1995 | Nakahigashi et al. | 124/56 |

FOREIGN PATENT DOCUMENTS 721398 3/1995 Japan .

*Primary Examiner*—John A. Ricci

*Attorney, Agent, or Firm*—Sixbey, Friedman, Leedom & Ferguson, P.C.; Gerald J. Ferguson, Jr.

[57] ABSTRACT

A model gun with trajectory control function, which comprises a barrel structure including an outer barrel member and an inner barrel member, a tubular member provided in a rear end portion of the outer barrel member for forming a bullet holding portion by which a spherical sham bullet is temporarily held to be shot with gas pressure and a bullet guiding portion by which the spherical sham bullet shot from the bullet holding portion is guided into the inner barrel member, and a slippery member having a bullet contacting surface lower in friction coefficient than an inner surface of the bullet guiding portion and provided on an inner surface of a lower part of the bullet guiding portion in such a manner that the bullet contacting surface is variable in position to move in a direction of diameter of the bullet guiding portion, wherein a trajectory of the spherical sham bullet shot off through the barrel structure is controlled in response to the position of the bullet contacting surface of the slippery member in the direction of diameter of the bullet guiding portion.

8 Claims, 6 Drawing Sheets

MODEL GUN WITH TRAJECTORY CONTROL FUNCTION

BACKGROUND OF THE INVENTION

1. Field of the Invention

The present invention relates generally to a model gun with trajectory control function, and more particularly to an improvement in a model gun having trajectory control function in which a spherical sham bullet is temporarily put in a bullet holding portion provided just at the back of a barrel and then shot off through the barrel with gas pressure and the trajectory of the spherical sham bullet is controllable.

2. Description of the Prior Art

There has been proposed a model gun often called an air soft gun in which a bullet holding portion is provided just at the back of a barrel for holding temporarily a spherical sham bullet and the spherical sham bullet put temporarily in the bullet holding portion is shot off through the barrel with gas pressure supplied into the bullet holding portion. As for such a model gun as often called the air soft gun, there has been further proposed to extend the range of the spherical sham bullet shot with the gas pressure, without increasing the power of the spherical sham bullet, so as to raise the commercial value of the model gun.

In the case of the previously proposed model gun in which it is intended to extend the range of a spherical sham bullet shot off through a barrel with gas pressure, as shown in, for example, Japanese patent application published after examination under publication number 7-21398, the barrel is provided to be accompanied, at the back thereof, with a bullet shooting portion at which a spherical sham bullet is temporarily held, and a partitioned upper inner surface of a part of the barrel is formed with friction material so as to project slightly downward with the coefficient of friction thereof higher than that of a partitioned lower inner surface of the part of the barrel which is opposite to the partitioned upper inner surface.

With the arrangement thus proposed, the amount of the downward projection of the partitioned upper inner surface is adjusted by a friction adjusting mechanism which works in response to the operation of a control handle, so that both of the partitioned upper and lower inner surfaces of the barrel come into contact with the spherical sham bullet which passes through the barrel after shooting from the bullet shooting portion. The spherical sham bullet with which both of the partitioned upper and lower inner surfaces of the barrel come into contact is given a rotation in such a rotating direction as to cause the spherical sham bullet to be subjected to dynamic lift with its forward movement due to a difference between the friction arising between the partitioned upper inner surface of the barrel and the spherical sham bullet and the friction arising between the partitioned lower inner surface of the barrel and the sham bullet. Consequently, the range of the spherical sham bullet shot off through the barrel can be extended without increasing its power.

The rotation of the spherical sham bullet with which the spherical sham bullet is subjected to the dynamic lift with its forward movement is such a rotation as to move upward the front end of the spherical sham bullet moving forward in the right or left side view in the direction perpendicular to the forward movement of the spherical sham bullet. This rotation of the spherical sham bullet is referred to as an upward rotation, hereinafter.

In the model gun in which it is intended to extend the range of the spherical sham bullet shot off through the barrel, the upward rotation of the spherical sham bullet passing through the barrel is caused under a condition where the friction arising between the partitioned upper inner surface of the barrel and the spherical sham bullet passing through the barrel after shooting is arranged to be larger than the friction arising between the partitioned lower inner surface of the barrel and the spherical sham bullet passing through the barrel after shooting.

In such a model gun as aforementioned in which friction material is provided in a barrel for forming a partitioned upper inner surface of the barrel projecting slightly downward and the amount of the downward projection of the partitioned upper inner surface of the barrel is adjusted by a friction adjusting mechanism which works in response to the operation of a control handle, the friction material which forms the partitioned upper inner surface of the barrel projecting slightly downward is operative to press the spherical sham bullet passing through the partitioned upper inner surface of the barrel downward to a partitioned lower inner surface of the barrel and therefore the spherical sham bullet having passed through the partitioned upper inner surface of the barrel moves forward to a muzzle provided on the barrel along a path deviated slightly downward from a longitudinal axis line in the barrel.

Accordingly, the spherical sham bullet having passed through the partitioned upper inner surface of the barrel is put in a condition where a space is formed between an upper inner surface of the barrel and the spherical sham bullet and gas pressure with which the spherical sham bullet has been shot goes through the space forward to the muzzle. The gas pressure which goes through the space formed between the upper inner surface of the barrel and the spherical sham bullet from the rear to the front of the spherical sham bullet is undesirably operative to reduce the upward rotation of the spherical sham bullet which is given to the spherical sham bullet by the friction material which forms the partitioned upper inner surface of the barrel projecting slightly downward. As a result, the dynamic lift exerted on the spherical sham bullet with the upward rotation of the latter is so reduced as not to extend efficiently the range of the spherical sham bullet shot off through the barrel.

Further, under the structural arrangement in which the friction material is provided in the barrel for forming the partitioned upper inner surface of the barrel projecting slightly downward and the friction adjusting mechanism which works in response to the operation of the control handle is also provided for adjusting the amount of the downward projection of the partitioned upper inner surface of the barrel, the barrel is required to be subjected to a drilling process for forming thereon an opening through which the friction material is inserted into the barrel to form the partitioned upper inner surface of the barrel, and in addition, since the friction adjusting mechanism which comprises, for example, a cam member, a press member and so on for controlling the amount of projection of the friction material and the control handle accompanied with the friction adjusting mechanism are provided on the barrel which is provided with the opening through the drilling process, the whole construction containing the barrel comes undesirably to be complicated to use a large number of parts and to increase the cost of production.

OBJECTS AND SUMMARY OF THE INVENTION

Accordingly, it is an object of the present invention to provide a model gun with trajectory control function, in which a spherical sham bullet is temporarily put in a bullet holding chamber provided just at the back of a barrel and then shot off through the barrel with gas pressure and the trajectory of the spherical sham bullet is able to be controlled for extending the range of the sham bullet, and which avoids the aforementioned disadvantages encountered with the prior art.

Another object of the present invention is to provide a model gun with trajectory control function, in which a spherical sham bullet is temporarily put in a bullet holding chamber provided just at the back of a barrel and then shot off through the barrel with gas pressure and the trajectory of the spherical sham bullet is able to be controlled for extending the range of the sham bullet, and with which a trajectory control for the spherical sham bullet is so performed as to extend efficiently the range of the sham bullet by means of a mechanism simplified in construction to use parts decreased in number and to reduce the cost of production.

A further object of the present invention is to provide a model gun with trajectory control function, in which a spherical sham bullet is temporarily put in a bullet holding chamber provided just at the back of a barrel and then shot off through the barrel with gas pressure and the trajectory of the spherical sham bullet is able to be controlled for extending the range of the sham bullet, and with which the spherical sham bullet shot off through the barrel is effectively given an upward rotation in a trajectory control by means of a mechanism simplified in construction to use parts decreased in number and to reduce the cost of production, so that the range of the sham bullet is efficiently extended.

According to the present invention, there is provided a model gun with trajectory control function, which comprises a barrel structure including an outer barrel member and an inner barrel member, a tubular member provided in a rear end portion of the outer barrel member for forming a bullet holding portion by which a spherical sham bullet is temporarily held to be shot with gas pressure and a bullet guiding portion by which the spherical sham bullet shot from the bullet holding portion is guided into the inner barrel member, and a slippery member having a bullet contacting surface lower in friction coefficient than an inner surface of the bullet guiding portion formed in the tubular member and provided on an inner surface of a lower part of the bullet guiding portion in such a manner that the bullet contacting surface is variable in position to move in a direction of diameter of the bullet guiding portion, wherein a trajectory of the spherical sham bullet shot off through the barrel structure is controlled in response to the position of the bullet contacting surface of the slippery member in the direction of diameter of the bullet guiding portion.

In one embodiment, the inner barrel member is provided with a tapered rear end portion having the thickness reduced gradually toward a rear edge of the inner barrel member, which is put between the inner surface of the lower part of the bullet guiding portion formed in the tubular member and a front end portion of the slippery member provided on the inner surface of the lower part of the bullet guiding portion, and the inner barrel member is provided to be movable forward and backward relatively to the outer barrel member. Then, the front end portion of the slippery member is lifted from the inner surface of the lower part of the bullet guiding portion to rise or fall in accordance with the movement of the tapered rear end portion of the inner barrel member when the inner barrel member is moved forward and backward relatively to the outer barrel member, and thereby the position of the bullet contacting surface of the slippery member in the direction of diameter of the bullet guiding portion is controlled in response to the lift of the front end portion of the slippery member from the inner surface of the lower part of the bullet guiding portion.

In the model gun thus constituted in accordance with the present invention, when the spherical sham bullet shot from the bullet holding portion formed in the tubular member with gas pressure is guided through the bullet guiding portion formed in the tubular member into the inner barrel member, both of the bullet contacting surface of the slippery member provided on the inner Surface of the lower part of the bullet guiding portion and an inner surface of an upper part of the bullet guiding portion which is opposite to the bullet contacting surface of the slippery member come into contact with the spherical sham bullet which passes through the bullet guiding portion. Since the bullet contacting surface of the slippery member is lower in friction coefficient than the inner surface of the upper part of the bullet guiding portion, the spherical sham bullet with which both of the bullet contacting surface of the slippery member and the inner surface of the upper part of the bullet guiding portion come into contact is given an upward rotation due to a difference between the friction arising between the bullet contacting surface of the slippery member and the spherical sham bullet and the friction arising between the inner surface of the upper part of the bullet guiding portion and the spherical sham bullet.

Further, the bullet contacting surface of the slippery member is operative to press the spherical sham bullet passing through an interspace between the bullet contacting surface of the slippery member and the inner surface of the upper part of the bullet guiding portion upward to the inner surface of the upper part of the bullet guiding portion and therefore the spherical sham bullet guided through the bullet guiding portion into the inner barrel member moves forward in the inner barrel member go a muzzle provided on the barrel structure along a path deviated slightly upward from a longitudinal axis line in the inner barrel member.

Accordingly, the spherical sham bullet moving forward in the inner barrel member is put in a condition where a space is formed between a lower inner surface of the inner barrel member and the spherical sham bullet and gas pressure with which the spherical sham bullet has been shot goes through the space forward to the muzzle. The gas pressure which goes through the space formed between the lower inner surface of the inner barrel member and the spherical sham bullet from the rear to the front of the spherical sham bullet is desirably operative to emphasize the upward rotation of the spherical sham bullet which is given to the spherical sham bullet when the spherical sham bullet passes through the interspace between the bullet contacting surface of the slippery member and the inner surface of the upper part of the bullet guiding portion. As a result, the dynamic lift exerted on the spherical sham bullet with the upward rotation of the latter is so amplified as to extend efficiently the range of the spherical sham bullet shot off through the barrel structure.

The difference between the friction arising between the bullet contacting surface of the slippery member and the spherical sham bullet and the friction arising between the inner surface of the upper part of the bullet guiding portion and the spherical sham bullet is varied in response to the position of the bullet contacting surface of the slippery member in the direction of diameter of the bullet guiding portion, and therefore the upward rotation of the spherical sham bullet, which is given to the spherical sham bullet when the spherical sham bullet passes through the interspace between the bullet contacting surface of the slippery member and the inner surface of the upper part of the bullet guiding portion, is controlled in response to the position of the bullet contacting surface of the slippery member in the direction of diameter of the bullet guiding portion. As a result, the trajectory of the spherical sham bullet shot off through the barrel structure is controlled and adjusted in response to the position of the bullet contacting surface of the slippery member in the direction of diameter of the bullet guiding portion.

Consequently, with the model gun with trajectory control function according to the present invention, a trajectory control in which the spherical sham bullet shot off through the barrel structure is effectively given the upward rotation by means of a mechanism which includes the outer and inner barrel members and the tubular member and the slippery member provided in the rear end potion of the outer barrel member and is relatively simplified in construction to use parts decreased in number and to reduce the cost of production so that the range of the spherical shame bullet is efficiently extended without increasing its power, is surely carried out.

The above, and other objects, features and advantages of the present invention will become apparent from the following detailed description taken in conjunction with the accompanying drawings.

DESCRIPTION OF THE PREFERRED EMBODIMENT

Figure 1:
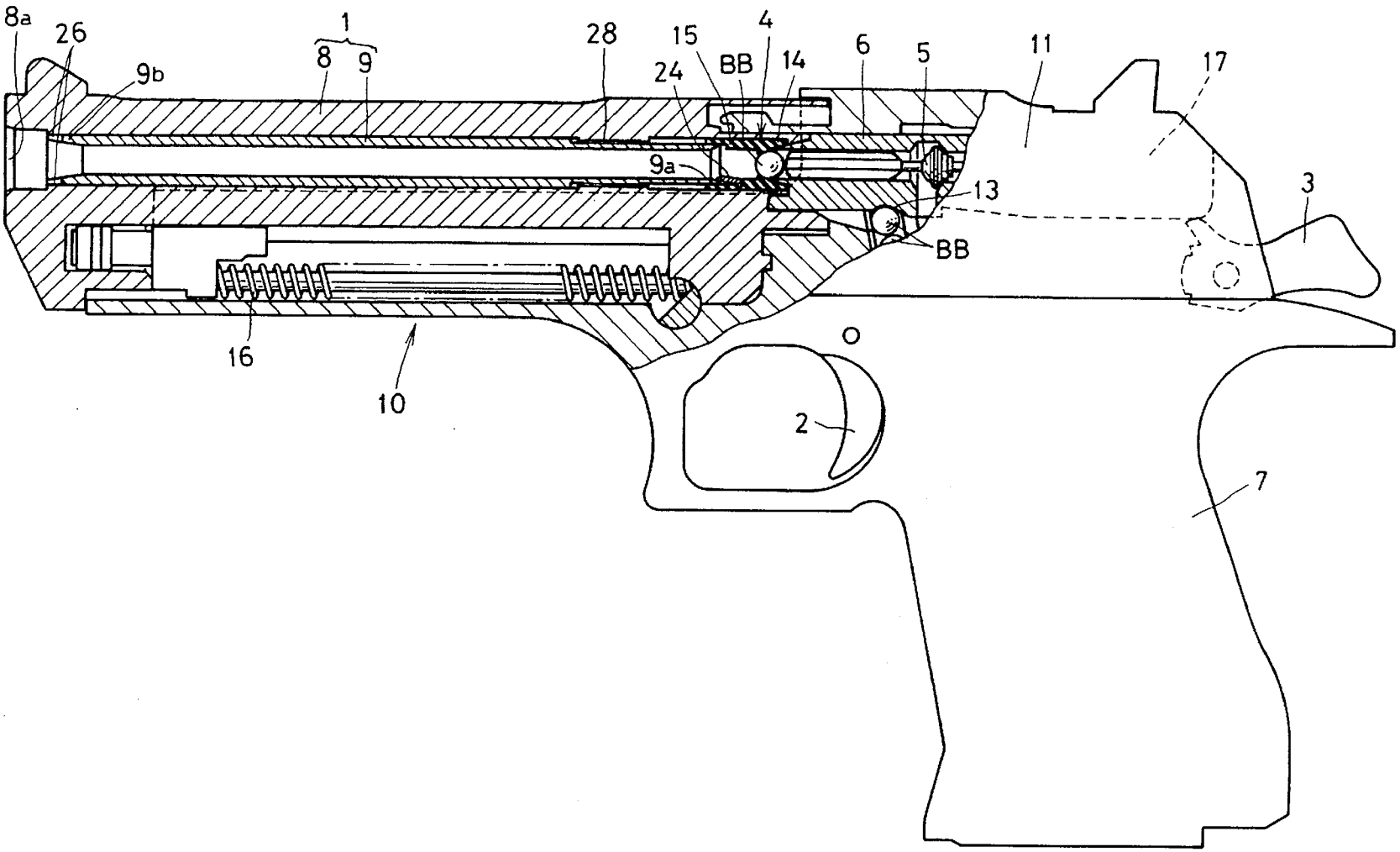
FIG. 1 is a schematic partial cross sectional view used for explaining the structure and operation of an embodiment of model gun with trajectory control function according to the present invention.

FIG. 1 shows an embodiment of model gun with trajectory control function according to the present invention.

Referring to FIG. 1, the embodiment has a barrel structure 1, a trigger 2, a hammer 3 rotating in cooperation with the trigger 2, a tubular member 4 positioned in a rear end portion of the barrel structure 1, a movable member 6 which is provided to be movable relatively to the tubular member 4 and in which a gas passage control valve 5 is provided, and a body 10 having a grip 7. The body 10 is further provided with a slider 11 which is movable forward and backward relatively to the barrel structure 1 and a case in which a pressure accumulating chamber which is charged with, for example, liquefied gas and a magazine for containing spherical sham bullets BB are provided is inserted to be detachable into the grip 7 (not shown in FIG. 1).

In the tubular member 4 positioned in the rear end portion of the barrel structure 1, one of the spherical sham bullets BB supplied from an upper end portion 13 of the magazine in the case inserted in the grip 7 is temporarily held and then shot to leave the tubular member 4 and the next spherical sham bullet BB is supplied from the upper end portion 13 of the magazine. The shooting of the spherical sham bullets BB held temporarily in the tubular member 4 and the supply of the spherical sham bullet BB into the tubular member 4 successive to the shooting are carried out with gas pressure discharged from the pressure accumulating chamber in the case inserted in the grip 7.

The barrel structure i comprises an outer barrel member 8 and an inner barrel member 9 which is shorter in length than the outer barrel member 8 and inserted into the outer barrel member 8 to be movable forward and backward within a predetermined extent relatively to the outer barrel member 8. The tubular member 4 is provided in a rear end portion of the outer barrel member 8 which projects backward from a tapered rear end portion 9*a* of the inner barrel member 9.

Figure 2:
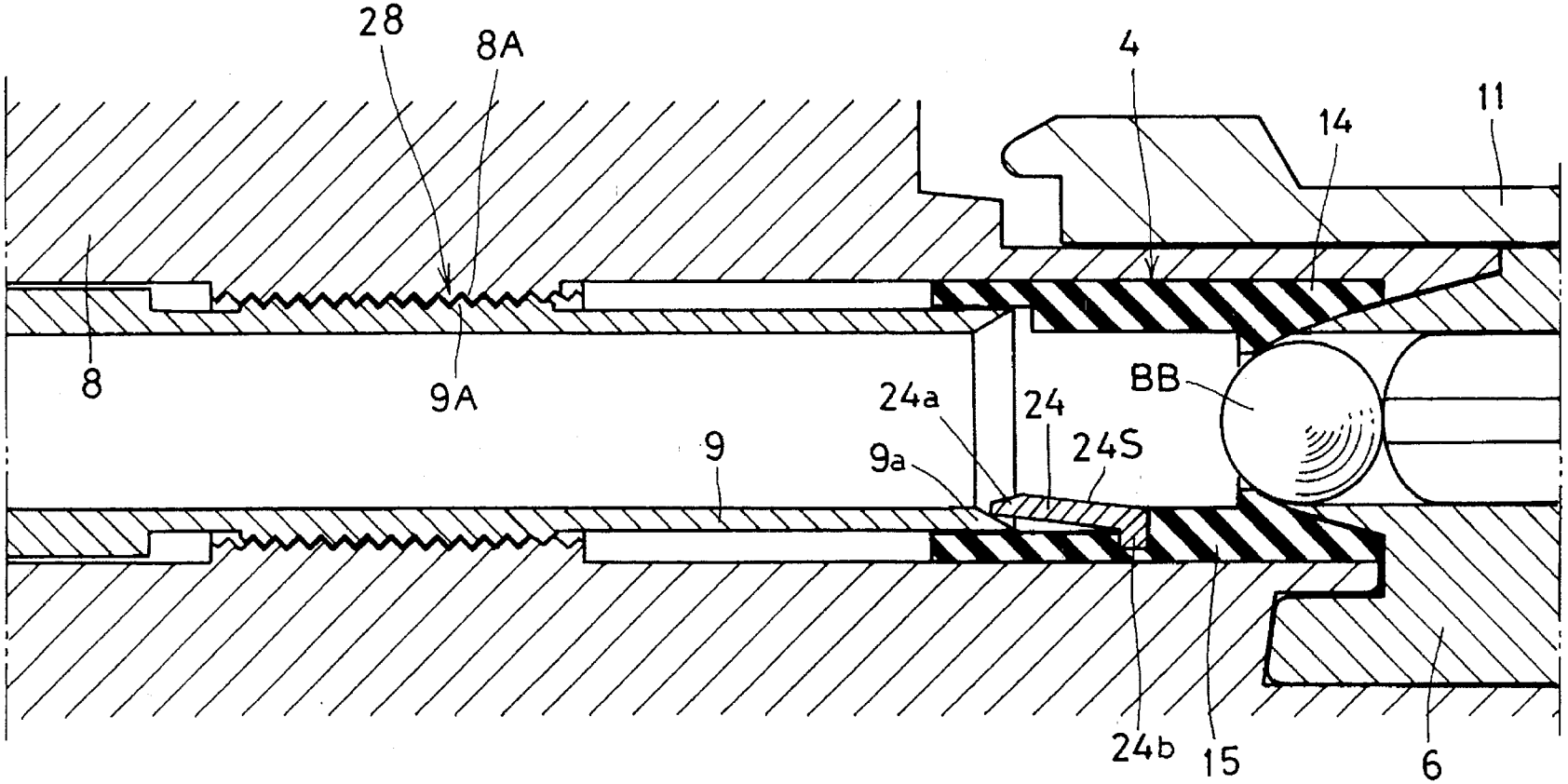
FIG. 2 a schematic cross sectional view showing an essential portion of the embodiment shown in FIG. 1.

The tubular member 4 is made in its entirety of elastic material, such as rubber or the like and forms a bullet holding portion 14 by which the spherical sham bullet BB supplied from the upper end portion 13 of the magazine in the case inserted into the grip 7 is temporarily held to be shot with the gas pressure and a bullet guiding portion 15 by which the spherical sham bullet BB shot from the bullet holding portion 14 is guided into the inner barrel member 9, as shown clearly in FIG. 2. The tapered rear end portion 9*a* of the inner barrel member 9 has the thickness thereof reduced gradually toward a rear edge of the inner barrel member 9 through which the spherical sham bullet BB is guided into the inner barrel member 9.

The slider 11 which is provided to be movable forward and backward relatively to the barrel structure 1 is forced to be put in tendency of moving forward by a coil spring 16 provided in a portion of the body 10 under the barrel structure 1. A pressure chamber 17 having variable capacity is formed in a rear portion of the slider 11 and the movable member 6 is positioned between the tubular member 4 and the pressure chamber 17.

Figure 3:
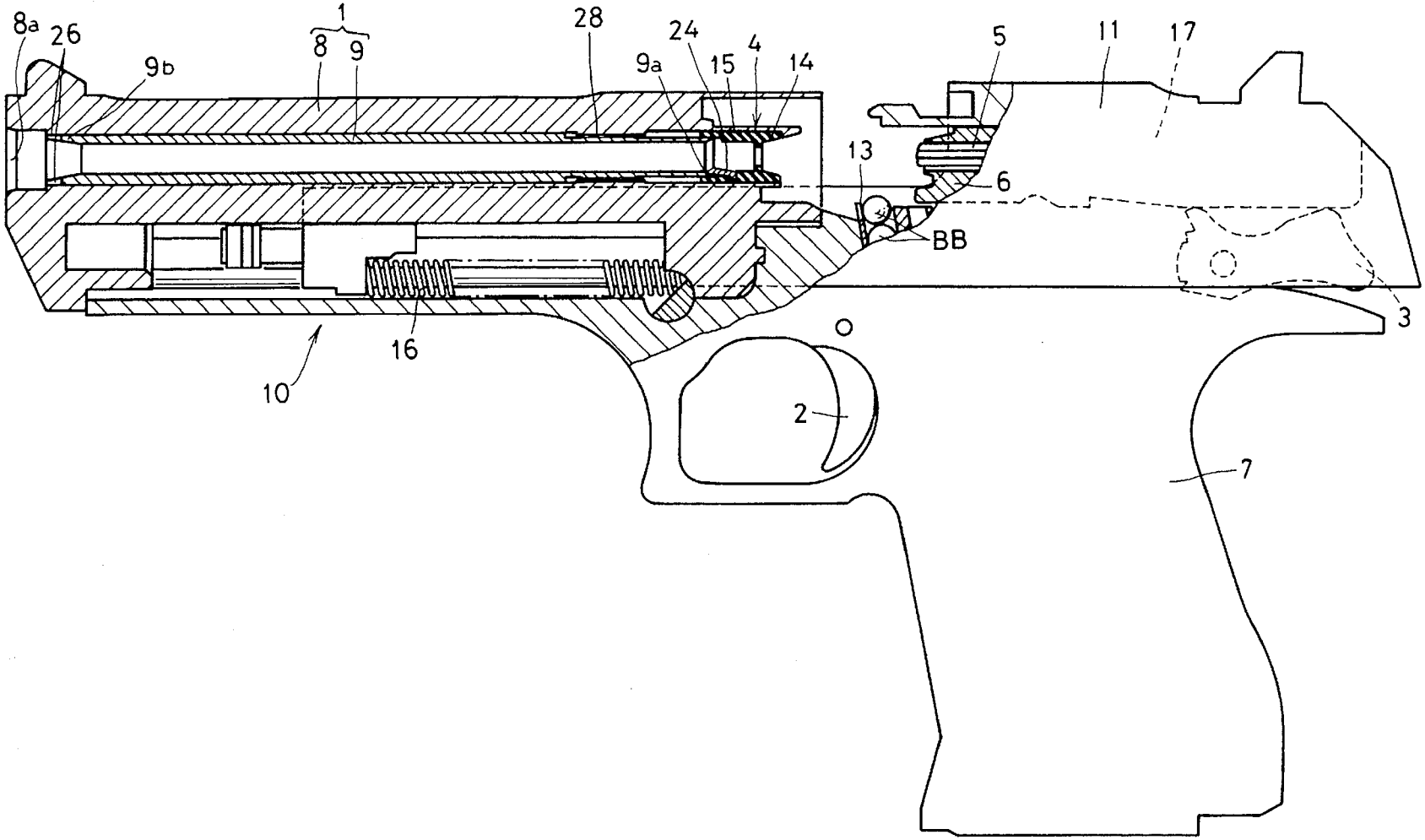
FIGS. 3 and 4 are schematic partial cross sectional views used for explaining the structure and operation of the embodiment shown in FIG. 1.

In the embodiment thus constituted to include the movable member 6, the slider 11 and the pressure chamber 17, when the operation for shooting the spherical sham bullet BB is carried out, at the start the slider 11 is once moved back manually from a reference position shown in FIG. 1 and then released to return to the reference position with elastic force by the coil spring 16. During such movements of the slider 11, as shown in FIG. 3, the movable member 6 which has its mid portion making the upper end portion 13 of the magazine closed is moved back with the backward movement of the slider 11, so that the upper end portion 13 of the magazine is made open and one of the spherical sham bullets BB at the top in the magazine is pushed up into the upper end portion 13 of the magazine to be held therein by 8 coil spring provided in the magazine. Then, the movable member 6 is moved forward with the forward movement of the slider 11 so as to carry the spherical sham bullet BB in the upper end portion 13 of the magazine toward the tubular member 4 and the upper end portion 13 of the magazine is closed again.

The spherical sham bullet BB carried into the tubular member 4 is temporarily held by the bullet holding portion 14 formed in the tubular member 4, as shown in FIG. 1. On that occasion, the gas passage control valve 5 in the movable member 6 is so positioned as to cause a front end thereof to come into contact with the spherical sham bullet BB held by the bullet holding portion 14 and thereby a gas passage through which a gas passage extending from the pressure accumulating chamber in the case inserted into the grip 7 is connected to the bullet holding portion 14 formed in the tubular member 4 is formed in the movable member 6.

Further, when the slider 11 is manually moved back, the hammer 3 is rotated to come down backward with the backward movement of the slider 11 and the hammer 3 having come down backward is maintained as it is after the slider 11 is moved forward to return to the reference position.

Under such a condition that the spherical sham bullet BB is temporarily held by the bullet holding portion 14 formed in the tubular member 4, as described above, the trigger 2 is pulled. Then, a driving mechanism which includes the hammer 3 rotating in cooperation with the trigger 2 is commenced to operate and thereby the hammer 3 is rotated to rise and a gas passage extending from the pressure accumulating chamber in the case inserted into the grip 7 is made open, so that a bullet shooting gas passage which extends from the pressure accumulating chamber in the case inserted into the grip 7 to the bullet holding portion 14 formed in the tubular member 4 is formed.

As a result of this, the gas pressure discharged from the pressure accumulating chamber in the case inserted in the grip 7 is supplied through the bullet shooting gas passage into the bullet holding portion 14 formed in the tubular member 4 to act on the spherical sham bullet BB held temporarily by the bullet holding portion 14, so that the spherical sham bullet BB held in the bullet holding portion 14 is shot from the bullet holding portion 14 toward the bullet guiding portion 15 with the gas pressure. Then, the spherical sham bullet BB shot from the bullet holding portion 14 is guided through the bullet guiding portion 15 into the inner barrel member 9 to move forward in the inner barrel member 9 and shot off through the barrel structure 1.

Figure 4:
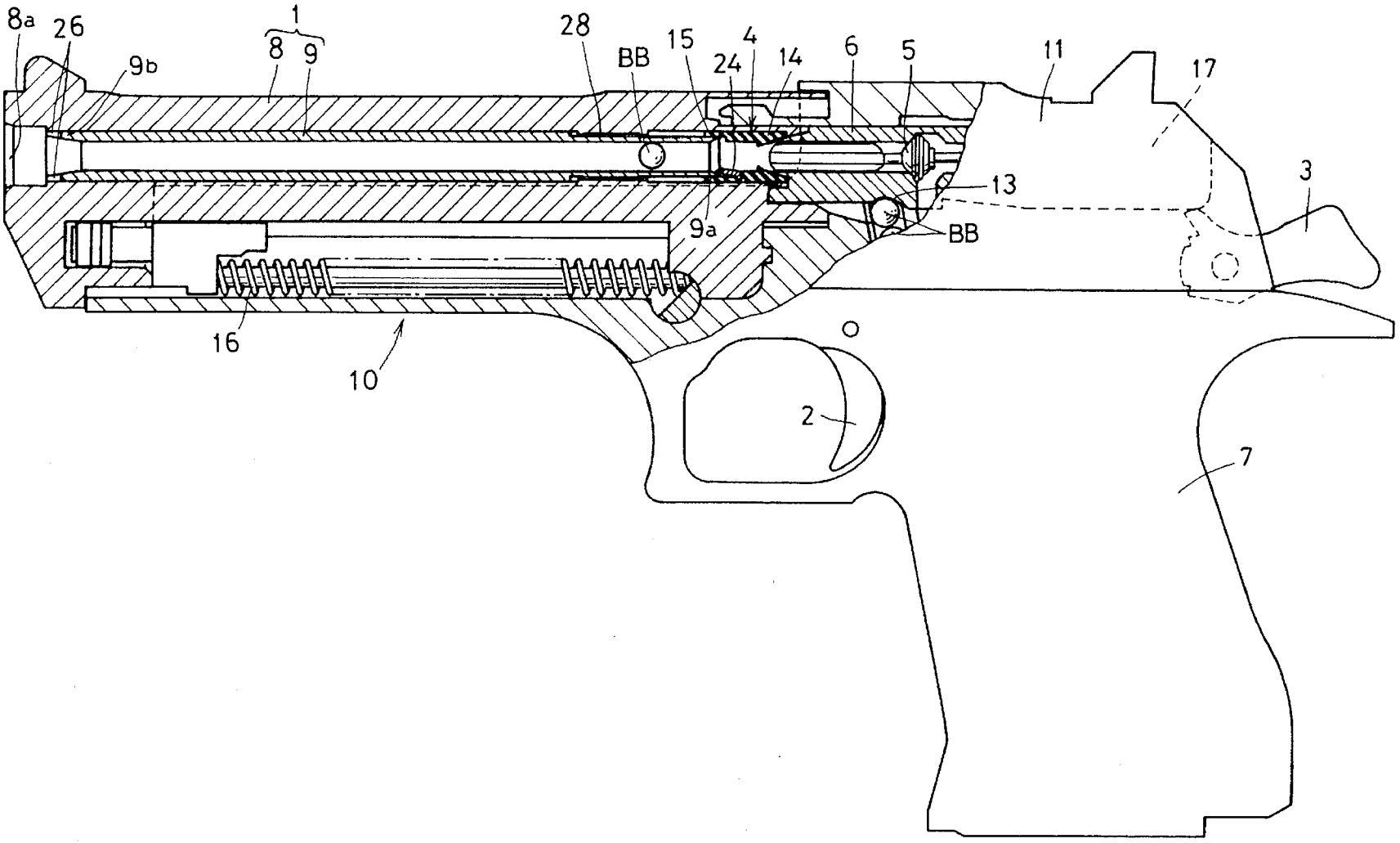

During such an operation for shooting the spherical sham bullet BB, after the spherical sham bullet BB held in the bullet holding portion 14 is shot from the bullet holding portion 14 toward the bullet guiding portion 15 with the gas pressure, as shown in FIG. 4, the gas passage control valve 5 which has been so positioned as to cause the front end thereof to come into contact with the spherical sham bullet BB held by the bullet holding portion 14 is moved forward with the gas pressure from the pressure accumulating chamber in the case inserted into the grip 7 to make the bullet shooting gas passage closed and to form a gas passage through which the gas passage extending from the pressure accumulating chamber in the case inserted into the grip 7 is connected to the pressure chamber 17, so that a blow-back gas passage which extends from the pressure accumulating chamber in the case inserted into the grip 7 to the pressure chamber 17 is formed.

Under a condition where the blow-back gas passage is formed, the gas pressure discharged from the pressure accumulating chamber in the case inserted into the grip 7 is supplied through the blow-back gas passage into the pressure chamber 17 to enlarge the capacity of the pressure chamber 17. With the enlargement of the capacity in the pressure chamber 17, a blow-back operation for moving the slider 11 back from the reference position and further for moving the movable member 6 back with the slider 11 is carried out.

After that, the gas pressure from the pressure accumulating chamber in the case inserted into the grip 7 is stopped to be supplied into the pressure chamber 17 and the gas pressure in the pressure chamber 17 is exhausted, so that the slider 11 having reached the rearmost position is moved forward by the coil spring 16 to return to the reference position together with the movable member 6. With such backward and forward movements of the movable member 6, the next spherical sham bullet BB is supplied from the upper end portion 13 of the magazine to the tubular member 4 to be held by the bullet holding portion 14 formed in the tubular member 4.

Figure 5:
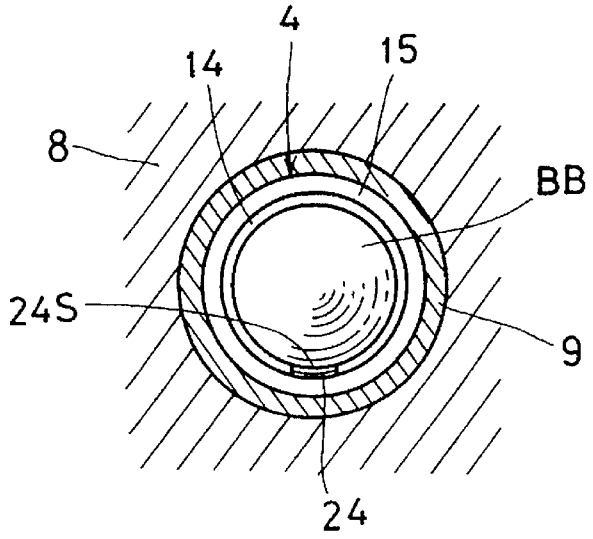
FIG. 5 is a schematic cross sectional view showing an essential portion of the embodiment shown in FIG. 1.

In the embodiment thus constituted as shown FIG. 1, a slippery member 24 which is made of, for example, slippery synthetic resin material is provided on an inner surface of a lower part of the bullet guiding portion 15 formed in the tubular member 4. As shown in FIG. 2, the slippery member 24 has a rear end portion **24*b* which is partially buried in the lower part of the bullet guiding portion 15, a front end portion 24*a* which is able to be lifted from the inner surface of the lower part of the bullet guiding portion 15, and a bullet contacting surface 24S which has a curvature along the inner surface of the lower part of the bullet guiding portion 15 and disposed to be opposite to an inner surface of an upper part of the bullet guiding portion 15, as shown in FIG. 5. The bullet contacting surface 24S of the slippery member 24 made of, for example, slippery synthetic resin material is lower in friction coefficient than the inner surface of the bullet guiding portion 15 formed in the tubular member 4. The front end portion 24*a* of the slippery member 24 is formed into a tapered portion having the thickness reduced gradually toward a front edge of the slippery member 24**.

The slippery member 24 is put in a condition where the rear end portion **24*b* is engaged with the lower part of the bullet guiding portion 15 and the front end portion 24*a* is rotatable within a predetermined angular extent with a pivot passing through the rear end portion 24*b* along a chord direction of the bullet guiding portion 15, so that the position of the bullet contacting surface 24S of the slippery member 24 is variable in the direction of diameter of the bullet guiding portion 15. The tapered rear end portion 9*a* of the inner barrel member 9, which has the thickness thereof reduced gradually toward the rear edge of the inner barrel member 9, is put between the inner surface of the lower part of the bullet guiding portion 15 and the front end portion 24*a* of the slippery member 24 provided on the inner surface of the lower part of the bullet guiding portion 15**.

As shown in FIG. 2, threads of screw 9A are provided on an outer surface of the inner barrel member 9 and another threads of screw 8A are provided on an inner surface of the outer barrel member 8 for engaging with the threads of screw 9A provided on the outer surface of the inner barrel member 9. When the inner barrel member 9 is rotated relatively to the outer barrel member 8, the inner barrel member 9 is moved forward or backward relatively to the outer barrel member 8 with the threads of screw 9A engaged with the threads of screw 8A.

In the case where the inner barrel member 9 is rotated to be moved forward a little relatively to the outer barrel member 8, the tapered rear end portion **9*a* of the inner barrel member 9 is also moved forward and thereby the front end portion 24*a* of the slippery member 24 is rotated to a small extent with the pivot passing through the rear end portion 24*b* along the chord direction of the bullet guiding portion 15 to reduce the amount of the lift from the inner surface of the lower part of the bullet guiding portion 15, so that the position of the bullet contacting surface 24S of the slippery member 24 in the direction of diameter of the bullet guiding portion 15 becomes more distant from the inner surface of the upper part of the bullet guiding portion 15**.

On the other hand, in the case where the inner barrel member 9 is rotated to be moved backward a little relatively to the outer barrel member 8, the tapered rear end portion **9*a* of the inner barrel member 9 is also moved backward and thereby the front end portion 24***a* of the slippery member 24 is rotated to a small extent with the pivot passing through the rear end portion 24*b* along the chord direction of the bullet guiding portion 15 to increase the amount of the lift from the inner surface of the lower part of the bullet guiding portion 15, so that the position of the bullet contacting surface 24S of the slippery member 24 in the direction of diameter of the bullet guiding portion 15 becomes more close to the inner surface of the upper part of the bullet guiding portion 15.

As described above, the position of the bullet contacting surface 24S of the slippery member 24 is varied in the direction of diameter of the bullet guiding portion 15 by rotating the inner barrel member 9 to be moved forward or backward relatively to the outer barrel member 8 with the threads of screw 9A engaged with the threads of screw 8A. Accordingly, the threads of screw 9A provided on the outer surface of the inner barrel member 9 and the threads of screw 8A provided on the inner surface of the outer barrel member 8 for engaging with the threads of screw 9A constitute a position adjusting mechanism 28 for adjusting the position of the bullet contacting surface 24S of the slippery member 24 in the direction of diameter of the bullet guiding portion 15.

Figure 6:
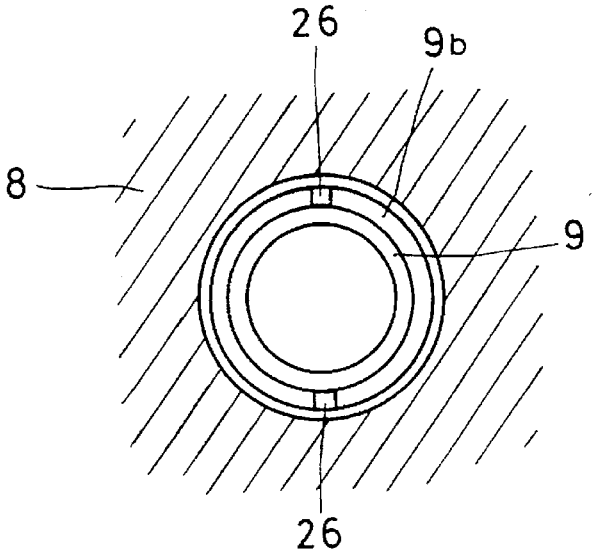
FIGS. 6, 7 and 8 are schematic partial cross sectional views used for explaining the operation of essential portions of the embodiment shown in FIG. 1.

The inner barrel member 9 has a front edge 9*b* which faces to the outside of the barrel structure 1 through a muzzle 8*a* provided on a front end portion of the outer barrel member 8, as shown in FIG. 6. A pair of grooves 26 are provided on the front edge 9*b* of the inner barrel member 9 to be disposed along the direction of diameter of the inner barrel member 9. These grooves 26 are used for rotating the inner barrel member 9 relatively to the outer barrel member 8, for example, in such a manner that a blade portion of a screw driver is engaged with the grooves 26 to rotate the inner barrel member 9.

With such a structural arrangement that the slippery member 24 having the bullet contacting surface 24S is provided on the inner surface of the lower part of the bullet guiding portion 15 formed in the tubular member 4 as described above, when the spherical sham bullet BB shot from the bullet holding portion 14 formed in the tubular member 4 with the gas pressure is guided through the bullet guiding portion 15 formed also in the tubular member 4 into the inner barrel member 9, both of the bullet contacting surface 24S of the slippery member 24 provided on the inner surface of the lower part of the bullet guiding portion 15 and the inner surface of the upper part of the bullet guiding portion 15, which is opposite to the bullet contacting surface 24S of the slippery member 24, come into contact with the spherical sham bullet BB which passes through an interspace between the bullet contacting surface 24S of the slippery member 24 and the inner surface of the upper part of the bullet guiding portion 15.

Figure 7:
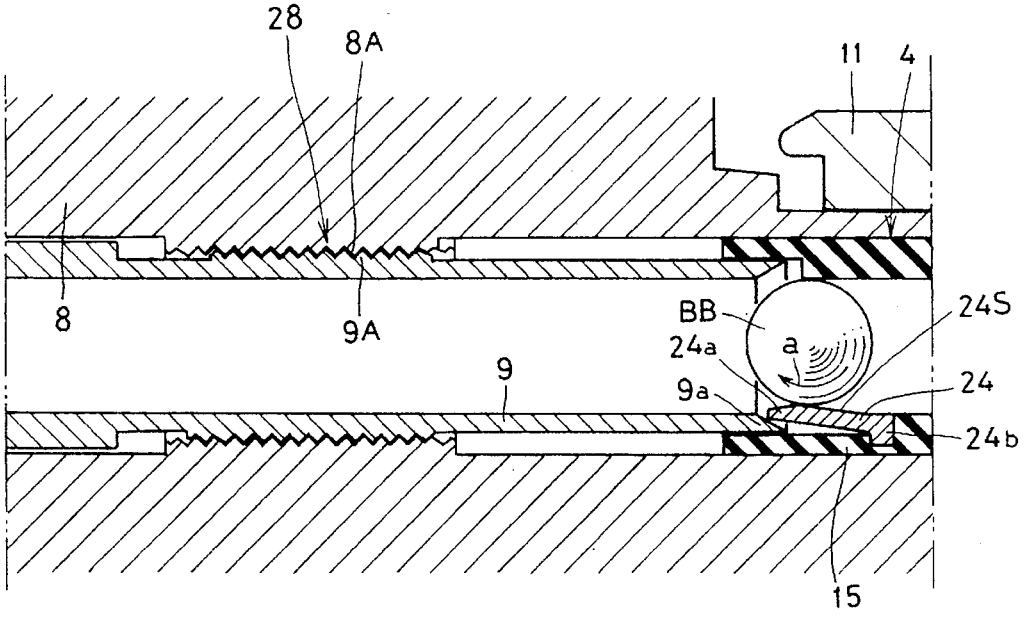

On that occasion, since the bullet contacting surface 24S of the slippery member 24 is lower in friction coefficient than the inner surface of the upper part of the bullet guiding portion 15, the friction arising between the bullet contacting surface 24S of the slippery member 24 and the spherical sham bullet BB is smaller than the friction arising between the inner surface of the upper part of the bullet guiding portion 15 and the spherical sham bullet BB. Therefore, the spherical sham bullet BB with which both of the bullet contacting surface 24S of the slippery member 24 and the inner surface of the upper part of the bullet guiding portion 15 come into contact is given an upward rotation, as shown with an arrow a in each of FIGS. 7 and 8, due to a difference between the friction arising between the bullet contacting surface 24S of the slippery member 24 and the spherical sham bullet BB and the friction arising between the inner surface of the upper part of the bullet guiding portion 15 and the spherical sham bullet BB. The upward rotation of the spherical sham bullet BB, which is given to the spherical sham bullet BB when the spherical sham bullet BB passes through the interspace between the bullet contacting surface 24S of the slippery member 24 and the inner surface of the upper part of the bullet guiding portion 15, is varied in degree in response to the difference between the friction arising between the bullet contacting surface 24S of the slippery member 24 and the spherical sham bullet BB and the friction arising between the inner surface of the upper part of the bullet guiding portion 15 and the spherical sham bullet BB.

Further, the bullet contacting surface 24S of the slippery member 24 is operative to press the spherical sham bullet BB passing through the interspace between the bullet contacting surface 24S of the slippery member 24 and the inner surface of the upper part of the bullet guiding portion 15 upward to the inner surface of the upper part of the bullet guiding portion 15 and therefore the spherical sham bullet BB guided through the bullet guiding portion 15 into the inner barrel member 9 moves forward in the inner barrel member 9 to the muzzle 8*a* provided on the front end portion of the outer barrel member 8 along a path deviated slightly upward from a longitudinal axis line in the inner barrel member 9.

Figure 8:
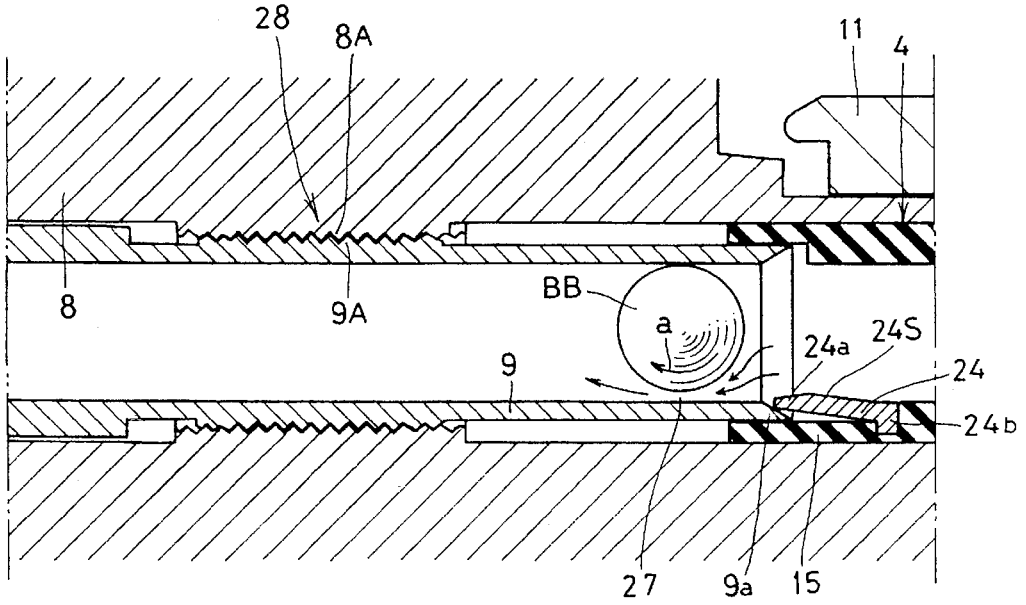

Accordingly, as shown in FIG. 8, the spherical sham bullet BB moving forward in the inner barrel member 9 is put in a condition where a space 27 is formed between a lower inner surface of the inner barrel member 9 and the spherical sham bullet BB, and the gas pressure with which the spherical sham bullet BB has been shot goes through the space 27 forward to the muzzle 8*a*, as shown with a plurality of allows in FIG. 8.

The gas pressure which goes through the space 27 formed between the lower inner surface of the inner barrel member 9 and the spherical sham bullet BB from the rear to the front of the spherical sham bullet BB exerts such a desirous effect on the spherical sham bullet BB as to emphasize the upward rotation of the spherical sham bullet BB which is given to the spherical sham bullet BB when the spherical sham bullet BB passes through the interspace between the bullet contacting surface 24S of the slippery member 24.and the inner surface of the upper part of the bullet guiding portion 15. As a result, the dynamic lift exerted on the spherical sham bullet BB with the upward rotation of the latter is so effectively amplified as to extend efficiently the range of the spherical sham bullet BB shot off through the barrel structure 1.

The difference between the friction arising between the bullet contacting surface 24S of the slippery member 24 and the spherical sham bullet BB and the friction arising between the inner surface of the upper part of the bullet guiding portion 15 and the spherical sham bullet BB is varied in response to the position of the bullet contacting surface 24S of the slippery member 24 in the direction of diameter of the bullet guiding portion 15. Therefore, the upward rotation of the spherical sham bullet BB, which is given to the spherical sham bullet BB when the spherical sham bullet BB passes through the interspace between the bullet contacting surface 24S of the slippery member 24 and the inner surface of the upper part of the bullet guiding portion 15, is controlled in response to the position of the bullet contacting surface 24S of the slippery member 24 in the direction of diameter of the bullet guiding portion 15. As a result, a trajectory of the spherical sham bullet BB shot off through the barrel structure 1 is controlled and adjusted in response to the position of the bullet contacting surface 24S of the slippery member 24 in the direction of diameter of the bullet guiding portion 15.

Incidentally, the adjustment of the position of the bullet contacting surface 24S of the slippery member 24 in the direction of diameter of the bullet guiding portion 15 by rotating the inner barrel member 9 to be moved forward on backward relatively to the outer barrel member 8 with the threads of screw 9A engaged with the threads of screw 8A, is carried out also for the purpose of putting the spherical sham bullet BB guided through the bullet guiding portion 15 into the inner barrel member 9 in a condition where both of the bullet contacting surface 24S of the slippery member 24 and the inner surface of the upper part of the bullet guiding portion 15 come into contact appropriately with the spherical sham bullet BB. For example, in the case where there are undesirable variations in the inside diameter of the bullet guiding portion 15 formed in the tubular member 4 or in the outside diameter of the spherical sham bullet BB, the position of the bullet contacting surface 24S of the slippery member 24 in the direction of diameter of the bullet guiding portion 15 is adjusted by rotating the inner barrel member 9 to be moved forward or backward relatively to the outer barrel member 8 with the threads of screw 9A engaged with the threads of screw 8A in order to absorb the undesirable variations in the inside diameter of the bullet guiding portion 15 formed in the tubular member 4 or in the outside diameter of the spherical sham bullet BB so as to obtain appropriate contacts between the spherical sham bullet BB and the bullet contacting surface 24S of the slippery member 24 and between the spherical sham bullet BB and the inner surface of the upper part of the bullet guiding portion 15, respectively.

Under such a situation as aforementioned, the bullet guiding portion 15 formed in the tubular member 4, the slippery member 24, the inner barrel member 9 provided with the threads of screw 9A, the outer barrel member 8 provided with the threads of screw 8A and so on constitute a trajectory control mechanism for controlling the trajectory of the spherical sham bullet BB shot off through the barrel structure 1. With the embodiment having such a trajectory control mechanism as shown in FIG. 1, a trajectory control in which the spherical sham bullet BB shot off through the barrel structure 1 is effectively given the upward rotation by the trajectory control mechanism which is relatively simplified in construction to use parts decreased in number and to reduce the cost of production so that the range of the spherical shame bullet BB is efficiently extended without increasing its power, is surely carried out.

What is claimed is:

1. A model gun with trajectory control function, which comprises;

a barrel structure including an outer barrel member and an inner barrel member, a tubular member provided in a rear end portion of said outer barrel member for forming a bullet holding portion by which a spherical sham bullet is temporarily held to be shot with gas pressure, and a bullet guiding portion by which the spherical sham bullet shot from the bullet holding portion is guided into said inner barrel member, and a slippery member having a bullet contacting surface lower in friction coefficient than an inner surface of the bullet guiding portion and provided on an inner surface of a lower part of the bullet guiding portion in such a manner that said bullet contacting surface is variable in position to move in a direction of diameter of the bullet guiding portion, wherein a trajectory of the spherical sham bullet shot off through said barrel structure is controlled in response to the position of the bullet contacting surface of said slippery member in the direction of diameter of the bullet guiding portion.

2. A model gun with trajectory control function according to claim 1, wherein said bullet contacting surface of the slippery member is provided with a curvature along the inner surface of the lower part of the bullet guiding portion.

3. A model gun with trajectory control function according to claim 1, wherein said slippery member is provided with a portion partially buried in the lower part of the bullet guiding portion.

4. A model gun with trajectory control function according to claim 3, wherein said slippery member is provided with a rear end portion which is partially buried in the lower part of the bullet guiding portion and a front end portion which is able to be lifted from the inner surface of the lower part of the bullet guiding portion and said inner barrel member is provided with a rear end portion put between the inner surface of the lower part of the bullet guiding portion and the front end portion of said slippery member.

5. A model gun with trajectory control function according to claim 4, wherein said rear end portion of said inner barrel member has its thickness reduced gradually toward a rear edge of said inner barrel member and is able to be moved forward and backward relatively to said outer barrel member, and the amount of the lift of the front end portion of said slippery member from the inner surface of the lower part of the bullet guiding portion is varied in response to movements of the rear end portion of said inner barrel member, so that a position of the bullet contacting surface of said slippery member in the direction of diameter of the bullet guiding portion is controlled.

6. A model gun with trajectory control function according to claim 5, wherein said inner barrel member is provided on its outer surface with first threads of screw, said outer barrel member is provided on its inner surface with second threads of screw operative to engage with the first threads of screw, and said inner barrel member is moved forward or backward relatively to said outer barrel member with the first threads of screw engaged with the second threads of screw when said inner barrel member is rotated relatively to said outer barrel member.

7. A model gun with trajectory control function according to claim 6, wherein said inner barrel member is provided with a front edge on which a pair of grooves are provided to be disposed along a direction of diameter of said inner barrel member and used for rotating said inner barrel member relatively to said outer barrel member.

8. A model gun with trajectory control function according to claim 1, wherein said tubular member is made of elastic material and said slippery member is made of slippery synthetic resin material.

* * * * *